US005534742A

United States Patent [19]

Krapp et al.

[11] Patent Number: 5,534,742

[45] Date of Patent: Jul. 9, 1996

[54] LAMP/REFLECTOR UNIT

[75] Inventors: Hans-Dieter Krapp, Nideggen-Schmidt; Martin Hanek, Baesweiler; Hubert Frings, Alsdorf, all of Germany

[73] Assignee: U.S. Philips Corporation, New York, N.Y.

[21] Appl. No.: 270,951

[22] Filed: Jul. 5, 1994

[30] Foreign Application Priority Data

Jul. 5, 1993 [EP] European Pat. Off. ..... 93201951

[51] Int. Cl.[6] ..... H01K 1/46

[52] U.S. Cl. ..... 313/113; 313/318.09; 313/318.1; 313/318.11; 439/611

[58] Field of Search ..... 313/113, 318, 313/318.01, 318.02, 318.05, 318.09, 318.10, 318.11; 439/611, 612, 616, 617, 619; 362/226

[56] References Cited

U.S. PATENT DOCUMENTS 4,396,860 8/1983 Hellwig et al. ..... 313/318.10

5,367,219 11/1994 Friedrichs ..... 313/113

FOREIGN PATENT DOCUMENTS 0367323 5/1990 European Pat. Off. .

0455035 11/1991 European Pat. Off. .

2153986 8/1985 United Kingdom .

*Primary Examiner*—Nimeshkumar D. Patel

*Attorney, Agent, or Firm*—Brian J. Wieghaus

[57] ABSTRACT

The reflector lamp unit has an electric lamp (10) mounted in a reflector body (1) having a neck (4). A metal sleeve (20) is present around the neck. The sleeve has outward projections (21) to provide grip to retention means of a lamp holder, and inward projections (22) which engage grooves (6) present in the neck. The free-end portion (5) of the neck (4) extends beyond the sleeve (20). The unit is of a simple construction, which nevertheless provides for a rigid coupling of the sleeve (20) to the reflector body (1) even with large tolerances as to the size of the neck (4). The unit, moreover, obviates the risk of short-circuiting the contact elements of a lampholder by the metal sleeve.

17 Claims, 2 Drawing Sheets

LAMP/REFLECTOR UNIT

BACKGROUND OF THE INVENTION

The invention relates to a reflector lamp unit comprising:

a glass reflector body provided with a concave reflecting surface having an optical axis, and around the optical axis a neck with a free-end portion;

an electric lamp with a lamp vessel which is sealed in a gastight manner and in which an electric element is arranged and connected to current conductors which issue to the exterior from a seal of the lamp vessel;

a metal sleeve fastened around the neck of the reflector body, which sleeve has projections which face away from one another and extend transversely to the optical axis, the electric lamp being secured in the neck and the current conductors each projecting from the neck and the sleeve to the exterior with a respective free end so as to form contact pins.

Such a reflector lamp unit is known from EP 0 367 323-A2. The metal sleeve in this case has the object of providing the unit with a profiled outer surface at which a lampholder, in which the unit is accommodated, can grip the unit by means of resilient retention means. It is prevented thereby that a lampholder is capable of holding the unit by the contact pins only, which provides too uncertain a retention of the unit.

GB 2 153 986-A discloses the provision of grooves in the neck of the reflector body, into which retention means can engage. A disadvantage of this is, however, that there is too wide a spread as regards the dimension of the neck in order to safeguard a good retention.

The reflector lamp of EP 0 367 323-A2 has the advantage that the metal sleeve has the profile with which retention means can cooperate and that the sleeve can be readily manufactured with narrow dimensional tolerances. A disadvantage is, however, that the sleeve in the known unit is fixed around the neck with cement and that its mounting as a result is time-consuming and accordingly expensive. Cement does render it possible to fix the sleeve immovably around the neck in spite of the dimensional variations in the latter. In this unit, the metal sleeve forms an extension of the neck. A disadvantage of this is the risk that the sleeve short-circuits the contact members of a lampholder, which need not be recessed in the case of lampholders for low-voltage lamps.

SUMMARY OF THE INVENTION

It is an object of the invention to provide a reflector lamp unit of the kind mentioned in the opening paragraph which is of a reliable and simple construction which is easy to manufacture.

According to the invention, this object is achieved in that the metal sleeve has projections which face one another and which enter grooves in the neck of the reflector body, and in that the neck projects with its free-end portion to outside the sleeve.

The construction of the unit according to the invention achieves a rigid coupling between the neck and the sleeve in spite of wide tolerances as regards the dimension of the neck and the grooves therein, thanks to the rigidity of a sleeve and the mutually facing projections thereof. This rigidity is in contrast to the flexibility of resilient retention means of a lampholder, which require a much greater dimensional accuracy of a body to be accommodated if they are to hold it securely. The construction also achieves that the risk of short-circuits in a lampholder is avoided. The free-end portion of the neck, indeed, projects to beyond the sleeve.

In a favourable embodiment in which the sleeve is formed from metal plating, the mutually facing projections which cooperate with the neck are farther removed from the free-end portion than are the projections facing away from one another which are to cooperate with a lampholder. This embodiment has the advantage that retention means can slide unhampered towards the projections with which they are associated. In a favourable modification thereof, the mutually facing projections are immediately adjacent each time to the projections facing away from one another. The concave sides of the mutually facing projections at the outside of the sleeve then form enlarged contact surfaces for the retention members at the rear of the projections facing away from one another.

It is favourable when the sleeve has a depression which presses against the neck of the reflector body. The depression may comprise one or several dents or folds. In the case of a sleeve with a substantially rectangular cross-section, the depression may be present in a side which lies between the sides having the projections. Such a depression increases the dimensional tolerance of the neck while a rigid coupling of the sleeve to the reflector body is maintained.

BRIEF DESCRIPTION OF THE DRAWINGS

An embodiment of the lamp/reflector unit according to the invention is shown in the drawing, in which.

DESCRIPTION OF THE PREFERRED EMBODIMENTS

Figure 1:
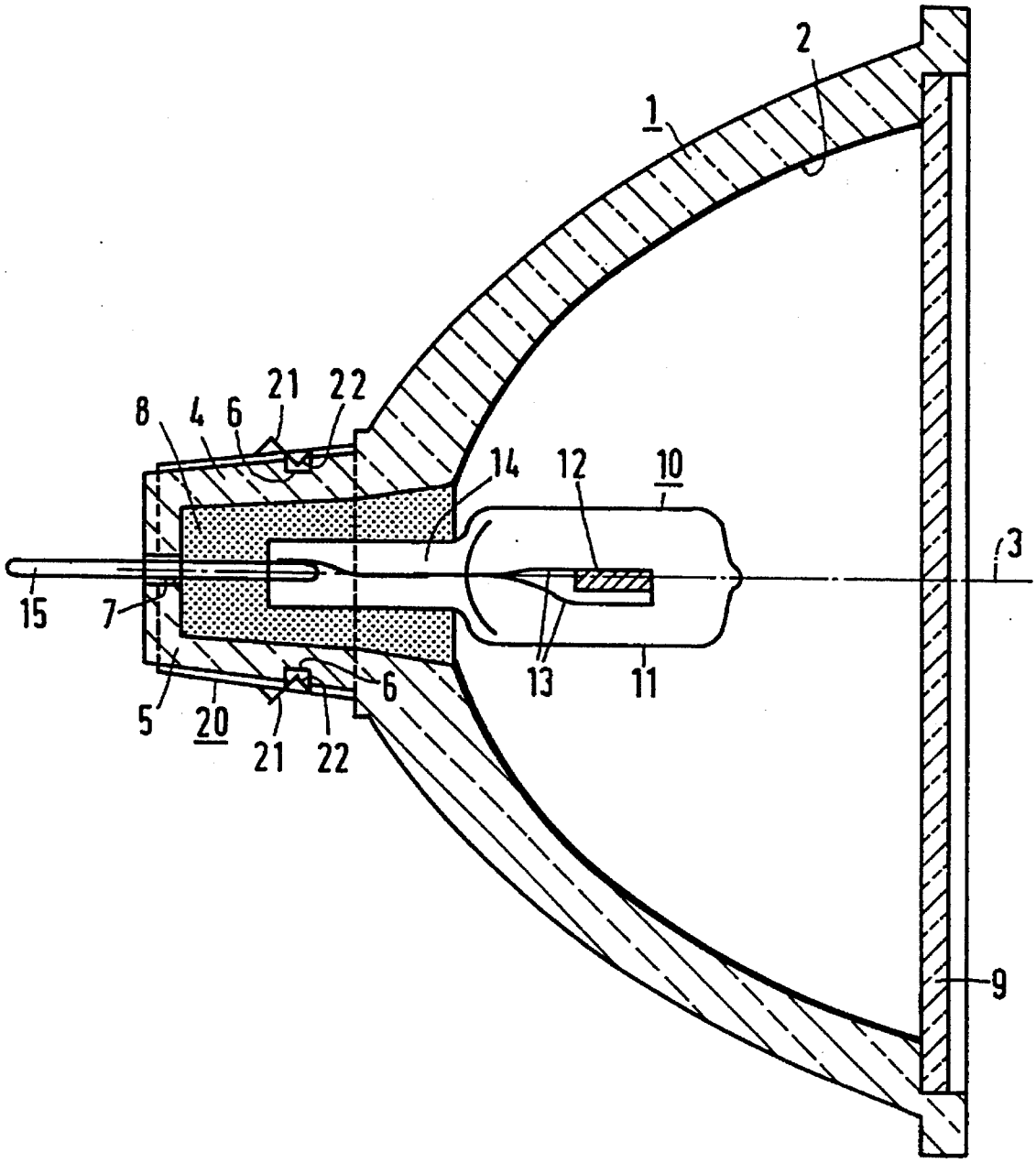
FIG. 1 shows a unit in axial cross-section.

In FIG. 1, the reflector lamp unit comprises a glass reflector body 1 which has a concave reflecting surface 2 with an optical axis 3 and, around the optical axis, a neck 4 with a free-end portion 5. The unit has an electric lamp 10 with a lamp vessel 11 which is sealed in a gastight manner and in which an electric element 12, an incandescent body in the Figure, but alternatively a pair of electrodes in an ionizable medium, is arranged and connected to current conductors 13 which issue to the exterior from a seal 14 of the lamp vessel. A metal sleeve 20 is fastened around the neck 4 of the reflector body, which sleeve has projections 21 which face away from one another and extend transversely to the optical axis 3. The electric lamp 10 is fixed in the neck 4, in the Figure by means of cement 8. The current conductors 13 project from the neck 4 through openings 7 and from the sleeve 20 to the exterior, each with a respective free end 15, so as to form contact pins.

The metal sleeve 20, made of steel in the Figure, has mutually facing projections 22 which enter grooves 6 in the neck 4 of the reflector body 1, while the neck 4 projects with its free-end portion 5 to outside the sleeve 20. The reflector body is closed off with a plate 9.

The mutually facing projections 22 lie farther removed from the free-end portion 5 than do the projections 21 facing away from one another.

Figure 2A:
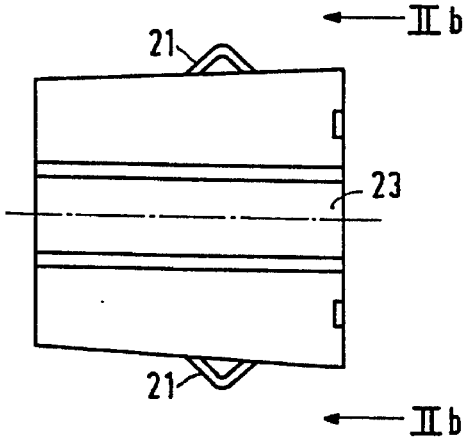
FIG. 2*a* is a side elevation of the sleeve of FIG. 1.
Figure 2B:
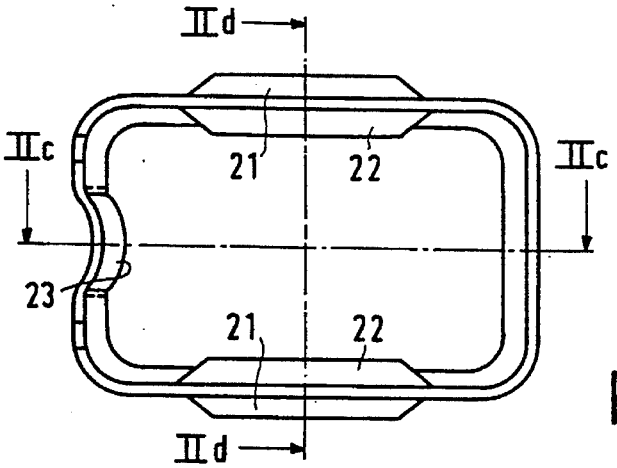
FIG. 2*b* is an elevation of the sleeve taken on IIb in FIG. 2*a;*
Figure 2C:
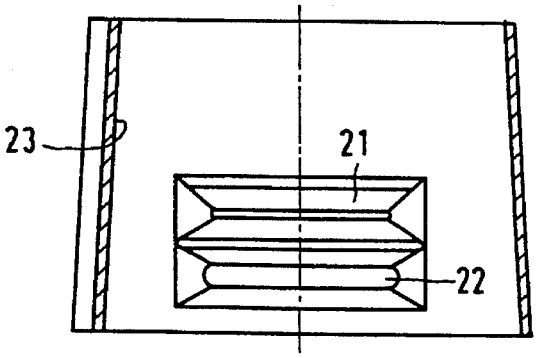
FIG. 2*c* is a cross-section taken on IIc—IIc in FIG. 2*b*.
Figure 2D:
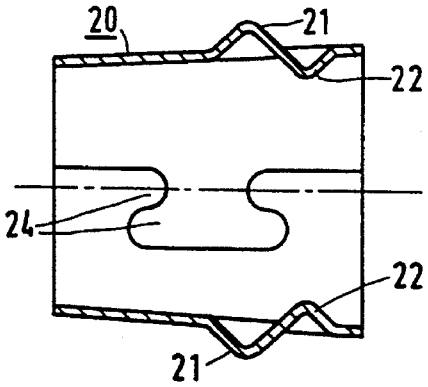
FIG. 2*d* is a cross-section taken on IId—IId in FIG. 2*b*.

The sleeve 20 is made from metal sheet and the mutually facing projections 22 are immediately adjacent to the projections 21 facing away from one another. Retention means of a lampholder as a result have extra large contact surfaces (see also FIG. 2*d*).

The sleeve 20 has a depression 23 which presses against the neck 4 of the reflector body 1, thus rendering possible a greater dimensional tolerance for the neck while a rigid coupling is retained.

The sleeve 20 has a dovetail closure 24. The sleeve is mounted in that it is passed over the neck until the projections 22 snap into the grooves 6.

What is claimed is:

1. A reflector lamp unit, comprising:

a glass reflector body including a concave reflecting surface having an optical axis, and around the optical axis a neck with a free-end portion;

an electric lamp with a lamp vessel having a seal sealing said lamp vessel in a gastight manner, an electric element arranged in the lamp vessel, and current conductors connected to said electric element and issuing to the exterior of said lamp vessel from said seal;

a metal sleeve fastened around the neck of the reflector body, which sleeve has projections which face away from one another and extend transversely to the optical axis, the electric lamp being secured in the neck, and the current conductors each projecting from the neck and the sleeve to the exterior with a respective free end so as to form contact pins, characterized in that the neck has grooves, the metal sleeve has projections which face one another and which enter the grooves in the neck of the reflector body, and in that the neck projects with its free-end portion to outside the sleeve.

2. A reflector lamp unit as claimed in claim 1, characterized in that the mutually facing projections are farther removed from the free-end portion than are the projections facing away from one another.

3. A reflector lamp as claimed in claim 1, characterized in that the metal sleeve is made from metal sheet and wherein each of the mutually facing projections are immediately adjacent to a corresponding one of the projections facing away from one another.

4. A reflector lamp unit as claimed in claim 3, characterized in that the sleeve has a depression which presses against the neck of the reflector body.

5. A reflector lamp unit as claimed in claim 2, characterized in that the sleeve has a depression which presses against the neck of the reflector body.

6. A reflector lamp unit as claimed in claim 1, characterized in that the sleeve has a depression which presses against the neck of the reflector body.

7. A reflector lamp unit according to claim 6, wherein said neck portion has a rectangular cross-section, with first and second pairs of mutually opposing faces, said first pair of faces including said grooves and said depression on said sleeve pressing against a face of said second pair of faces, whereby said depression acts in a direction transverse to said snap fit connection.

8. A reflector lamp, comprising:

a) an electric lamp which is energizeable for emitting light;

b) a reflector holding said electric lamp, said reflector having a body with a reflective surface for directing light emitted by the lamp and a neck portion extending from said reflector body and including an indentation; and c) a sleeve fastened around said neck portion, said sleeve having an inwardly directed projection engaging in said indentation in said neck portion and forming a snap fit connection for locking said sleeve on said neck portion, and an outwardly directed projection extending from said inwardly directed projection and together with said inwardly directed projection forms a grasping surface for being grasped by a retention device of a socket receiving said neck portion.

9. A reflector lamp according to claim 8, wherein said neck portion projects beyond said sleeve.

10. A reflector lamp according to claim 9, wherein said neck portion includes a plurality of side faces, and said sleeve includes a resilient projection pressing against a side face not including said indentation of said snap fit connection.

11. A reflector lamp according to claim 10, wherein said neck portion has a rectangular cross-section, with first and second pairs of mutually opposing faces, said first pair of faces including said indentation for said snap connection and said resilient projection pressing against a face of said second pair of faces, whereby said resilient projection acts in a direction transverse to said snap fit connection.

12. A reflector lamp according to claim 7, wherein said neck portion has a rectangular cross-section, with first and second pairs of mutually opposing faces, said first pair of faces including said snap-fit connection, and said sleeve having a resilient projection pressing against a face of said second pair of faces, whereby said resilient projection acts in a direction transverse to said snap fit connection.

13. A reflector lamp according to claim 12, wherein said neck portion projects beyond said sleeve.

14. A reflector for a lamp, said reflector comprising:

a) a body with a reflective surface for directing light emitted by the lamp and a neck portion extending from said reflector body and including an indentation; and b) a sleeve fastened around said neck portion, said sleeve having an inwardly directed projection engaging in said indentation in said neck portion and forming a snap fit connection for locking said sleeve on said neck portion, and an outwardly directed projection extending from said inwardly directed projection and together with said inwardly directed projection forms a grasping surface extending into said indentation in said neck portion for being grasped by a retention device of a socket receiving said neck portion.

15. A reflector according to claim 14, wherein said neck portion projects beyond said sleeve.

16. A reflector lamp according to claim 14, wherein said neck portion has a rectangular cross-section, with first and second pairs of mutually opposing faces, said first pair of faces including said snap-fit connection, and said sleeve having a resilient projection pressing against a face of said second pair of faces, whereby said resilient projection acts in a direction transverse to said snap fit connection.

17. A reflector according to claim 16, wherein said neck portion projects beyond said sleeve.

* * * * *